US012687126B2

(12) United States Patent
Wilhelmsson et al.

(10) Patent No.: US 12,687,126 B2
(45) Date of Patent: Jul. 21, 2026

(54) APPROACHES FOR DIAGNOSTICS OF NOx SENSOR(S)

(71) Applicant: VOLVO TRUCK CORPORATION, Gothenburg (SE)

(72) Inventors: Martin Wilhelmsson, Torslanda (SE); Leo Laine, Gothenburg (SE); Oscar Stjernberg, Gothenburg (SE); Roland Kvist, Braås (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 19/174,321

(22) Filed: Apr. 9, 2025

(65) Prior Publication Data

US 2025/0327416 A1 Oct. 23, 2025

(30) Foreign Application Priority Data

Apr. 17, 2024 (EP) ..... 24170858

(51) Int. Cl.

| | |
|---|---|
| ***F01N 11/00*** | (2006.01) |
| ***B60W 50/02*** | (2012.01) |
| ***F02D 29/02*** | (2006.01) |
| ***F02D 41/14*** | (2006.01) |

(Continued)

(52) U.S. Cl.

CPC ..... *F01N 11/007* (2013.01)

(58) Field of Classification Search

CPC ... B60W 50/0205; F01N 11/00; F01N 11/007; F01N 2550/00; F01N 2560/026; F01N 2900/0416; F01N 9/00; F02D 29/02; F02D 41/146; F02D 41/222; F02D 41/2432; F02D 2250/06; F02D 2250/18; F02D 2250/24; Y02T 10/12; Y02T 10/40; Y02T 10/62; Y02T 10/64

See application file for complete search history.

(56) References Cited

U.S. PATENT DOCUMENTS 6,311,480 B1 11/2001 Suzuki et al.
7,610,142 B1 10/2009 Hoard et al.

(Continued)

FOREIGN PATENT DOCUMENTS

WO 2013152780 A1 10/2013

OTHER PUBLICATIONS

Extended European Search Report in corresponding European Application No. 24170858.5 dated Oct. 1, 2024 (9 pages).

*Primary Examiner* — Dapinder Singh

(74) *Attorney, Agent, or Firm* — Jeffri A. Kaminski; Venable LLP

(57) ABSTRACT

A computer-implemented method is disclosed for diagnostics of NOx sensor(s) of a vehicle. The method comprises—while the electric motor(s) are not driven by the ICE—controlling (by processing circuitry of a computer system) the ICE to operate according to a predefined operational mode, wherein the predefined operational mode has a correspondingly predefined expected, non-zero, NOx sensor response, controlling (by the processing circuitry) the NOx sensor(s) to perform measurements associated with the predefined operational mode of the ICE, and acquiring (by the processing circuitry) corresponding measurement results from the NOx sensor(s) for comparison to the predefined expected NOx sensor response.

16 Claims, 5 Drawing Sheets

(51) Int. Cl.
*F02D 41/22* (2006.01)
*F02D 41/24* (2006.01)

(56) References Cited

U.S. PATENT DOCUMENTS

| | | | | |
|---|---|---|---|---|
| 8,694,197 | B2 * | 4/2014 | Rajagopalan | F02D 41/222 701/2 |
| 8,930,121 | B2 * | 1/2015 | Rajagopalan | F02D 41/123 73/114.61 |
| 10,267,778 | B2 * | 4/2019 | Gong | G01N 33/0037 |
| 10,513,961 | B2 * | 12/2019 | Yoo | F02D 41/1494 |
| 10,724,463 | B2 * | 7/2020 | Sakumoto | F02D 41/0055 |
| 10,883,410 | B2 * | 1/2021 | Yoo | F01N 11/007 |
| 11,434,841 | B2 * | 9/2022 | Korpics | F01N 13/008 |
| 11,536,183 | B1 * | 12/2022 | Ott | F01N 11/00 |
| 2011/0138779 | A1 * | 6/2011 | Neumayer | F01N 3/208 60/274 |
| 2012/0255277 | A1 * | 10/2012 | Rajagopalan | F02D 41/222 60/274 |
| 2016/0209383 | A1 * | 7/2016 | Gong | F01N 3/2066 |
| 2016/0232723 | A1 | 8/2016 | Karlsson et al. | |
| 2017/0074846 | A1 * | 3/2017 | Bell | F02D 41/222 |
| 2017/0260922 | A1 | 9/2017 | Emig et al. | |
| 2019/0203623 | A1 * | 7/2019 | Yoo | F02D 41/222 |
| 2022/0195956 | A1 | 6/2022 | Korpics et al. | |
| 2022/0341354 | A1 | 10/2022 | Gelso et al. | |
| 2023/0003163 | A1 * | 1/2023 | Stenqvist | F02D 41/021 |

* cited by examiner

APPROACHES FOR DIAGNOSTICS OF NOx SENSOR(S)

TECHNICAL FIELD

The disclosure relates generally to vehicle control. In particular aspects, the disclosure relates to diagnostics of nitrogen oxide (NOx) sensor(s). The disclosure can be applied to heavy-duty vehicles, such as trucks, buses, and construction equipment, among other vehicle types. Although the disclosure may be described with respect to a particular vehicle, the disclosure is not restricted to any particular vehicle.

BACKGROUND

Vehicles that comprise an internal combustion engine (ICE) configured to provide energy for propulsion and/or other purposes are commonly equipped with one or more nitrogen oxide (NOx) sensor(s) configured to perform measurements relating to exhausts of the ICE.

One purpose of the NOx sensor(s) is to ensure compliance with emission regulations. To this end—and others—it is desirable that measurements performed by the NOx sensor(s) are reliable and accurate. Therefore, there is a need for approaches for diagnostics of NOx sensor(s).

SUMMARY

According to a first aspect of the disclosure, a computer system is provided for diagnostics of NOx sensor(s) of a vehicle. The vehicle comprises one or more electric motor(s) for propulsion, an internal combustion engine (ICE) configured to provide energy for driving the electric motor(s), and one or more other energy source(s) for driving the electric motor(s). The computer system comprises processing circuitry configured to—while the electric motor(s) are not driven by the ICE—control the ICE to operate according to a predefined operational mode, wherein the predefined operational mode has a correspondingly predefined expected, non-zero, NOx sensor response, control the NOx sensor(s) to perform measurements associated with the predefined operational mode of the ICE, and acquire corresponding measurement results from the NOx sensor(s) for comparison to the predefined expected NOx sensor response. The first aspect of the disclosure may seek to enable improved diagnostics of NOx sensor(s) (e.g., in terms of accuracy, reliability, etc.). A technical benefit may include that NOx sensor(s) are more accurately calibrated and/or that malfunction of NOx sensor(s) is more reliably detected. Thereby, compliance with emission regulations may be more reliably ensured.

According to a second aspect of the disclosure, a computer-implemented method is provided for diagnostics of NOx sensor(s) of a vehicle. The vehicle comprises one or more electric motor(s) for propulsion, an internal combustion engine (ICE) configured to provide energy for driving the electric motor(s), and one or more other energy source(s) for driving the electric motor(s). The method comprises—while the electric motor(s) are not driven by the ICE—controlling (by processing circuitry of a computer system) the ICE to operate according to a predefined operational mode, wherein the predefined operational mode has a correspondingly predefined expected, non-zero, NOx sensor response (500), controlling (by the processing circuitry) the NOx sensor(s) to perform measurements associated with the predefined operational mode of the ICE, and acquiring (by the processing circuitry) corresponding measurement results from the NOx sensor(s) for comparison to the predefined expected NOx sensor response. The second aspect of the disclosure may seek to enable improved diagnostics of NOx sensor(s) (e.g., in terms of accuracy, reliability, etc.). A technical benefit may include that NOx sensor(s) are more accurately calibrated and/or that malfunction of NOx sensor(s) is more reliably detected. Thereby, compliance with emission regulations may be more reliably ensured. Alternatively or additionally, a technical benefit may include that elaborate NOx sensor diagnostics is enabled even during use of the vehicle (e.g., when the vehicle is executing a route and/or is in motion).

Optionally in some examples, including in at least one preferred example, the predefined operational mode may be defined by a steady-state engine operation point. A technical benefit may include that continuous measurements may be performed over a relatively long duration of time (e.g., as compared to measurements relating to a pulse-shaped sensor response), which may enable validation of measurement consistency, for example.

Optionally in some examples, including in at least one preferred example, the predefined expected NOx sensor response may be defined by one or more of: a peak amplitude, a duration, a pulse shape, and a total emission. A technical benefit may include that suitable parameters are provided for the comparison of measurement results to the predefined expected NOx sensor response.

Optionally in some examples, including in at least one preferred example, controlling the ICE to operate according to the predefined operational mode may comprise causing (by the processing circuitry) single ignition operation of the ICE. A technical benefit may include that a way to implement consistently repeatable measurement conditions is provided.

Optionally in some examples, including in at least one preferred example, controlling the ICE to operate according to the predefined operational mode may comprise causing (by the processing circuitry) a corresponding specific level of fuel injection. A technical benefit may include that an amplitude of the NOx sensor response can be varied by corresponding variation of the level of fuel injection.

Optionally in some examples, including in at least one preferred example, controlling the ICE to operate according to the predefined operational mode may comprise causing (by the processing circuitry) a corresponding torque to be applied to a crank shaft of the ICE. A technical benefit may include that a simulated load can be varied by corresponding variation of the applied torque. Alternatively or additionally, a technical benefit may include that the applied torque implements a steady-state engine operation point.

Optionally in some examples, including in at least one preferred example, causing the torque to be applied to the crank shaft of the ICE may comprise controlling (by the processing circuitry) an electric generator of the vehicle to operate in reverse to generate the torque. A technical benefit may include that way to implement the torque application is provided.

Optionally in some examples, including in at least one preferred example, controlling the ICE to operate according to the predefined operational mode may comprise causing (by the processing circuitry) the ICE to run at a corresponding engine speed. A technical benefit may include that the engine speed implements a steady-state engine operation point.

Optionally in some examples, including in at least one preferred example, the method may further comprise calibrating (by the processing circuitry) the NOx sensor(s) based on the comparison of the measurement results to the predefined expected NOx sensor response. A technical benefit may include improved (e.g., more accurate) measurements following the calibration.

Optionally in some examples, including in at least one preferred example, the method may further comprise issuing (by the processing circuitry) a NOx sensor malfunction alert responsive to calibration failure. A technical benefit may include that an operator, or service, function of the vehicle is made aware of that NOx sensor service and/or replacement is needed.

Optionally in some examples, including in at least one preferred example, the method may further comprise triggering (by the processing circuitry) the predefined operational mode to be applied—while the electric motor(s) are not driven by the ICE—responsive to one or more of a specific time interval having passed since previously performed measurements associated with the predefined operational mode of the ICE, and an indication of NOx sensor malfunction. A technical benefit may include that the NOx sensor diagnostics can be automatically performed with periodicity and/or when malfunction is suspected.

Optionally in some examples, including in at least one preferred example, the method may further comprise—before controlling the NOx sensor(s) to perform the measurements—causing (by the processing circuitry) the NOx sensor(s) to be brought to a specified temperature. A technical benefit may include that more relevant measurements are provided when the NOx sensor(s) require a minimum and/or specified temperature to perform measurements.

Optionally in some examples, including in at least one preferred example, causing the NOx sensor(s) to be brought to the specified temperature may comprise—before controlling the ICE to operate according to the predefined operational mode—controlling (by the processing circuitry) the ICE to pre-heat the NOx sensor(s). A technical benefit may include that separate heating elements are not required.

According to a third aspect of the disclosure, a vehicle is provided comprising NOx sensor(s), one or more electric motor(s) for propulsion, an internal combustion engine (ICE) configured to provide energy for driving the electric motor(s), one or more other energy source(s) for driving the electric motor(s), and the computer system of the first aspect. The third aspect of the disclosure may seek to provide a vehicle with improved diagnostics of NOx sensor(s) (e.g., in terms of accuracy, reliability, etc.). A technical benefit may include that NOx sensor(s) are more accurately calibrated and/or that malfunction of NOx sensor(s) is more reliably detected. Thereby, compliance with emission regulations may be more reliably ensured. Alternatively or additionally, a technical benefit may include that elaborate NOx sensor diagnostics is enabled even during use of the vehicle (e.g., when the vehicle is executing a route and/or is in motion).

According to a fourth aspect of the disclosure, a computer program product is provided. The computer program product comprises program code for performing, when executed by processing circuitry, the method of the second aspect.

According to a fifth aspect of the disclosure, a non-transitory computer-readable storage medium is provided. The non-transitory computer-readable storage medium comprises instructions, which when executed by processing circuitry, cause the processing circuitry to perform the method of the second aspect.

The fourth and/or fifth aspect of the disclosure may seek to convey program code for enabling improved diagnostics of NOx sensor(s) (e.g., in terms of accuracy, reliability, etc.). A technical benefit may include that new vehicles and/or legacy vehicles comprising NOx sensor(s), one or more electric motor(s) for propulsion, an internal combustion engine (ICE) configured to provide energy for driving the electric motor(s), one or more other energy source(s) for driving the electric motor(s) may be conveniently configured, by software installation/update, to control the ICE to operate according to a predefined operational mode, wherein the predefined operational mode has a correspondingly predefined expected, non-zero, NOx sensor response, control the NOx sensor(s) to perform measurements associated with the predefined operational mode of the ICE, and acquire corresponding measurement results from the NOx sensor(s) for comparison to the predefined expected NOx sensor response; all while the electric motor(s) are not driven by the ICE.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

There are also disclosed herein computer systems, control units, code modules, computer-implemented methods, computer readable media, and computer program products associated with the above discussed technical benefits.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

This disclosure relates generally to vehicles that comprise an internal combustion engine (ICE) configured to provide energy for propulsion and/or other purposes (e.g., climate control, etc.). Such vehicles are commonly equipped with one or more nitrogen oxide (NOx) sensor(s) configured to perform measurements relating to exhausts of the ICE.

Generally, the ICE could run on any suitable type of fuel that generated NOx exhaust gas (e.g., gasoline, diesel, hydrogen gas, natural gas, etc.).

Such measurements may be used for one or more of a variety of purposes. For example, the measurements may be used for evaluation of compliance with emission regulations, performance control, energy consumption control, etc. In some examples, the operation of the ICE may be dynamically adjusted based on the measurements (e.g., change one or more parameters—such as engine speed, gear, fuel injection, etc.—to reduce relatively high emissions and/or reduce energy consumption). For example, the ICE may be controlled to operate at an operational point that is optimal under the condition that emission regulations are fulfilled; possibly together with one or more other requirement(s) (e.g., durability, driveability, etc.).

It is generally desirable that measurements performed by the NOx sensor(s) are reliable and accurate. To this end, the NOx sensor(s) need to be properly calibrated.

It may be advantageous to be able to do (re-)calibration automatically and/or during use of the vehicle (e.g., since changed circumstances may cause a previous calibration to become outdated or obsolete). Furthermore, it may be advantageous to be able to do calibration in relation to various operational modes of the ICE (e.g., to improve measurement accuracy).

According to the approaches described herein, the vehicle comprises one or more electric motor(s) for propulsion, and the ICE is configured to provide energy for driving the electric motor(s). The vehicle also comprises one or more other energy source(s) for driving the electric motor(s). While the electric motor(s) are not driven by the ICE (e.g., while the electric motor(s) are driven by one of the other energy source(s), or while the electric motor(s) are braking), the ICE is correspondingly available for other purposes than driving the electric motor(s), and this is utilized by the approaches described herein.

Figure 1:
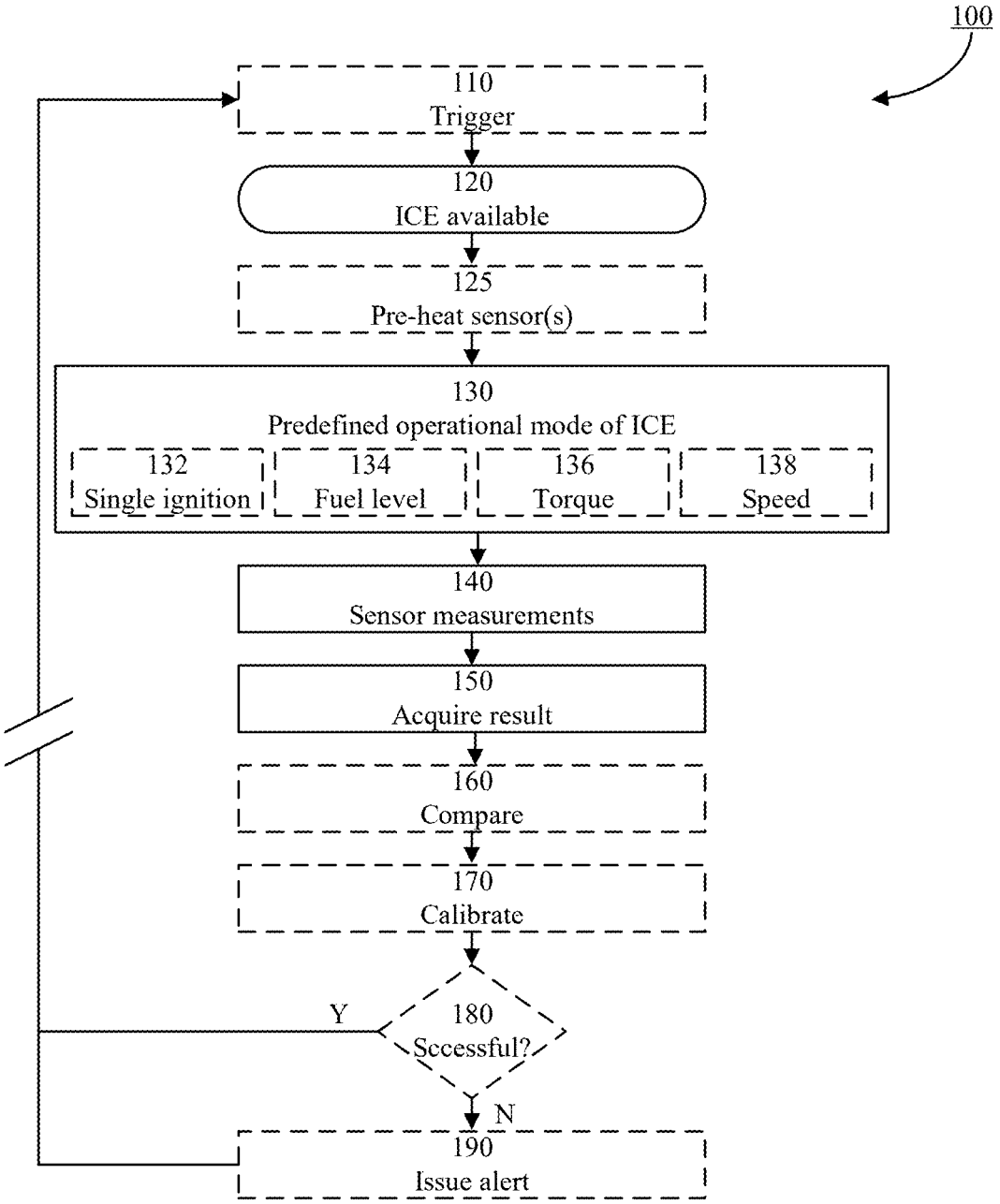
FIG. 1 is a flowchart illustrating a method according to some examples.

FIG. 1 illustrates a method 100 according to some examples. The method 100 is suitable for diagnostics of NOx sensor(s) of a vehicle that comprises one or more electric motor(s) for propulsion, an ICE configured to provide energy for driving the electric motor(s), as well as one or more other energy source(s) for driving the electric motor(s). The diagnostics may, for example, be used for (re-)calibration of the NOx sensor(s) as elaborated on above. Alternatively or additionally, the diagnostics may be used to detect malfunctioning of the NOx sensor(s). To this end, any type of malfunctioning may be relevant where the NOx sensor measurements are not sufficiently similar to the expected NOx sensor response (i.e., reduced accuracy or reliability, as well as break down). For example, malfunctioning may be due to the NOx sensor(s) being affected by other substances than NOx gases.

The approach implemented by the method 100 utilizes the availability of the ICE when the electric motor(s) are not driven by the ICE. That is, when the ICE is not currently used for generating electric power to drive the electric motor(s), it can be left idle or it can be used for other purposes; e.g., to perform controlled measurements by the NOx sensor(s) as explored by the method 100.

While the electric motor(s) are not driven by the ICE, and the ICE is correspondingly available (as illustrated by 120), the method 100 comprises controlling the ICE to operate according to a predefined operational mode (as illustrated by step 130), controlling the NOx sensor(s) to perform measurements associated with the predefined operational mode of the ICE (as illustrated by step 140), and acquiring corresponding measurement results from the NOx sensor(s) (as illustrated by step 150). Thereby, automatic (re-)calibration during use of the vehicle is enabled.

The predefined operational mode of the ICE has a correspondingly predefined expected, non-zero, NOx sensor response (an expected gas concentration as a function of time). The predefined expected NOx sensor response may be acquired in any suitable way (e.g., via previously performed bench tests, controlled vehicle tests, ICE product specifications, NOx sensor product specifications, etc.).

Generally, there may be used two or more different predefined operational modes, each with a respective predefined expected NOx sensor response. In the latter case, at least one of the predefined expected NOx sensor responses is a non-zero response, while one or more of the predefined expected NOx sensor responses may be a zero response. The operation of the ICE in the predefined operational mode(s) enables refined calibration compared to calibration only in relation to zero NOx levels.

The predefined expected NOx sensor response may have any possible shape (e.g., a pulse or a continuum). For example, the predefined operational mode of the ICE may comprise a single impulse operation of the ICE, in which case a pulse-shaped response may be expected. Alternatively or additionally, the predefined operational mode of the ICE may be defined by a steady-state engine operation point, in which case a continuously shaped response may be expected.

The measurement results acquired from the NOx sensor(s) in step 150 may be used for any suitable purpose. For example, they are suitable for comparison to the predefined expected NOx sensor response.

To this end, the method 100 may comprise comparing the measurement results acquired from the NOx sensor(s) to the predefined expected NOx sensor response (as illustrated by optional step 160). The comparison may involve comparing any one or more feature(s) of the predefined expected NOx sensor response with corresponding one or more feature(s) of the measurement results acquired from the NOx sensor(s).

Example features (parameters) of the predefined expected NOx sensor response that may be used in the comparison include peak amplitude (of pulse or continuum), duration (of pulse), shape (of pulse or continuum), total emission (of pulse or during a specified time of the continuum), average emission (of continuum), etc.

The method 100 may further comprise calibrating the NOx sensor(s) based on the comparison of the measurement results to the predefined expected NOx sensor response (as illustrated by optional step 170). For example, if one of the compared features differs between the measurement results acquired from the NOx sensor(s) and the predefined expected NOx sensor response, the NOx sensor(s) may be calibrated to mitigate (e.g., eliminate) the difference. If none of the compared features differs between the measurement results acquired from the NOx sensor(s) and the predefined expected NOx sensor response, calibration may be omitted.

In some examples, the method 100 comprises determining whether or not the calibration in step 170 was successful (as illustrated by optional step 180). When the calibration was successful (Y-path out of step 180), the method 100 may be considered completed and/or may be restarted for a new iteration of NOx sensor diagnostics. When the calibration was not successful (N-path out of step 180), the method 100 may continue to optional step 190, where a NOx sensor malfunction alert is issued responsive to the calibration failure. Unsuccessful calibration may be indicated in any suitable way. An indication of unsuccessful calibration might include that already collected and/or subsequent measurements by the allegedly calibrated sensor(s) are deemed to be erroneous and/or unreliable. For example, calibration may be deemed unsuccessful when measurements are substantially different from expected—or even physically possible—values (e.g., using some suitable metric for the difference and comparison to a threshold value).

The sensor malfunction alert may be intended to inform an operator of the vehicle (e.g., a driver) and/or a service function of the vehicle (e.g., fleet management, or service, function) that NOx sensor service and/or replacement is needed.

For example, the sensor malfunction alert may be rendered via a user interface of the vehicle (e.g., an information screen, a malfunction light, or similar). Alternatively or additionally, the sensor malfunction alert may be uploaded to a centralized (e.g., cloud-based) service function.

Generally, the predefined operational mode may be any suitable operational mode which has a correspondingly predefined expected NOx sensor response, and a few examples will be given herein.

One example predefined operational mode is achieved by operating the ICE in revers to pump air through the ICE cylinders and the after-treatment system. This predefined operational mode typically corresponds to a predefined expected NOx sensor response which is a zero response.

One example predefined operational mode is achieved by operating the ICE by single ignition (as illustrated by optional sub-step 132). This may be seen as a way to implement single impulse operation of the ICE.

One example predefined operational mode is achieved by using a corresponding specific level of fuel injection (as illustrated by optional sub-step 134). This may be seen as a way to implement amplitude control of the NOx sensor response, and may be used for single impulse operation, as well as for steady-state engine operation.

One example predefined operational mode is achieved by applying a corresponding torque to the crank shaft of the ICE (as illustrated by optional sub-step 136). This may be seen as a way to simulate a corresponding load, and may be used for single impulse operation, as well as for steady-state engine operation. Typically, a relatively high torque results in a relatively high fuel injection, which typically causes relatively high cylinder temperature and—consequently—a relatively high level of NOx gases. Thus, this may be seen as a way to implement amplitude control of the NOx sensor response and/or control of the total emission for the NOx sensor response.

The torque may be applied in any suitable way, e.g., by controlling an electric generator of the vehicle to operate in reverse to generate the torque. For example, an electric generator that is primarily purposed to be driven by the ICE to generate electric power for the one or more electric motor(s) for propulsion may be used. The reverse operation of the electric generator may be powered by an energy storing system (ESS; e.g., a battery system), by excess power generated by the electric motor(s) during braking, or by other suitable means.

One example predefined operational mode is achieved by causing the ICE to run at a corresponding engine speed (as illustrated by optional sub-step 138). This may be seen as a way to implement steady-state engine operation. Typically, a relatively high engine speed results in a relatively high exhaust flow, which typically causes the NOx gases to reach the NOx sensor(s) relatively quickly. Thus, this may be seen as a way to implement control of the starting point of the NOx sensor response. Potentially, the concentration of NOx in the exhaust flow could be decreased with increased engine speed, since it might be diluted by other gases if the mass flow is relatively high.

Any suitable combinations of the above and/or other examples may also be used to implement the predefined operational mode (e.g., single ignition with a specific level of fuel injection, etc.).

As already mentioned, it may be advantageous to be able to do (re-)calibration repeatedly since changed circumstances may cause a previous calibration to become outdated or obsolete. To this end, the method 100 may comprise triggering performance of the previously described procedure (as illustrated by optional step 110).

For example, the triggering may be responsive to an event (e.g., an indication of NOx sensor malfunction). The indication of NOx sensor malfunction may be any suitable indication. Examples include: relatively low NOx readings while the ICE has relatively high temperature and/or uses a relatively high moment and/or has relatively high load, relatively high NOx readings while the ICE has relatively low temperature and/or uses a relatively low moment and/or has relatively low load, relatively long delay of NOx readings (slow response by NOx sensor(s)), etc.

Alternatively or additionally, the triggering may be responsive to a specific time interval having passed since previous measurements associated with a (the same or different) predefined operational mode of the ICE were performed (e.g., periodical triggering).

The procedure triggered in step 110 is initiated when the ICE is available. For example, the method 100 may comprise waiting until the ICE becomes available, or causing the ICE to become available by switching drive of the electric motor(s) to one of the other energy source(s). In either case, the triggered procedure may be initiated as soon as the ICE becomes available, or later.

Oftentimes, NOx sensor(s) should have a specified (minimum) temperature to be able to provide relevant measurements. To this end, the method 100 may comprise—efore controlling the NOx sensor(s) to perform the measurements (step 140)—causing the NOx sensor(s) to be brought to a specified temperature (as illustrated by optional step 125). If the NOx sensor(s) are inactive, step 125 may also comprise activating them.

The NOx sensor(s) may be brought to the specified temperature by any suitable means. For example, heating elements may be used. Alternatively or additionally, the NOx sensor(s) may be brought to the specified temperature by—before controlling the ICE to operate according to the predefined operational mode (step 130)—controlling the ICE to pre-heat the NOx sensor(s). Controlling the ICE to pre-heat the NOx sensor(s) may comprise operating the ICE to run in any suitable way that causes the NOx sensors to be heated up (e.g., due to heated exhaust gases being pushed through/passed the NOx sensors). Typically, suitable ICE operations for NOx sensor pre-heating also needs to fulfill other requirements (e.g., emission regulations).

Figure 2:
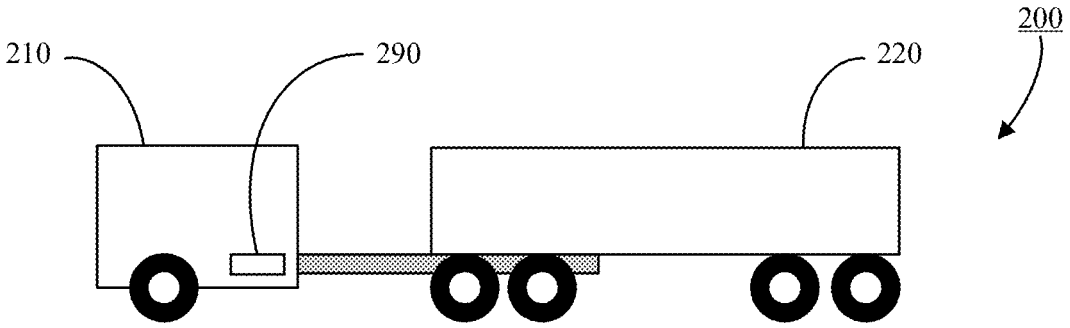
FIG. 2 is a schematic drawing illustrating a vehicle according to some examples.

FIG. 2 schematically illustrates an example vehicle 200 for cargo transport where the techniques disclosed herein can be advantageously applied. The vehicle 200 comprises a truck/tractor/towing unit 210 configured to tow one or more trailer unit(s) 220 in a known manner.

The vehicle 200 comprises NOx sensor(s), one or more electric motor(s) for propulsion, an internal combustion engine (ICE) configured to provide energy for driving the electric motor(s), and one or more other energy source(s) for driving the electric motor(s). Furthermore, the vehicle 200 comprises a computer system configured to perform, or cause performance of, one or more steps of the method 100 of FIG. 1.

For example, the tractor unit 210 and/or the trailer unit(s) 220 may comprise a vehicle control unit (VCU) 290 configured to perform various vehicle control functions, such as vehicle motion management (VMM), power/energy management, etc. Any of one or more VCU(s) 290 may be configured to perform, or cause performance of, one or more steps of the method 100 of FIG. 1. Thus, the techniques disclosed herein may be performed by any of one or more VCU(s) 290 of the vehicle 200.

Figure 3:
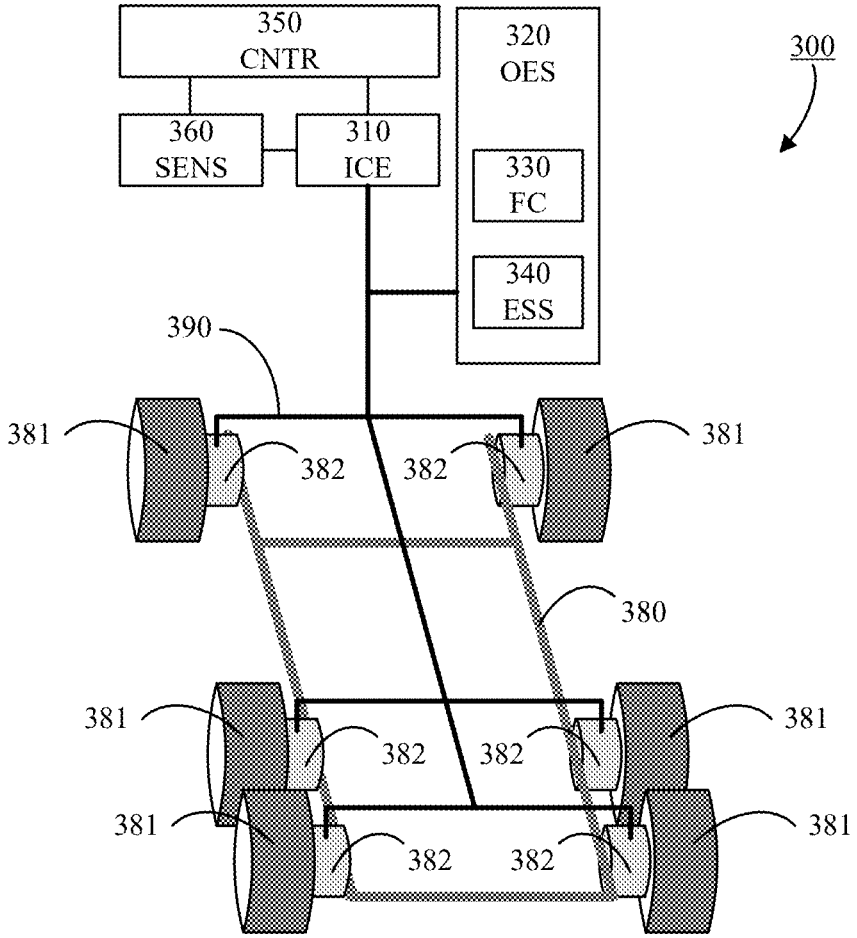
FIG. 3 is a schematic drawing illustrating a vehicle sub-system according to some examples.

FIG. 3 schematically illustrates a vehicle sub-system 300 according to some examples. For example, the vehicle sub-system 300 may be suitable in relation to performance of one or more steps of the method 100 of FIG. 1. Alternatively or additionally, the vehicle sub-system 300 may be comprised in a vehicle (e.g., the vehicle 200 of FIG. 2).

The vehicle-subsystem 300 is particularly suitable for a vehicle platform, which is also schematically illustrated in FIG. 3.

According to the vehicle platform, wheels 381 are mounted in relation to a frame structure 390, and one or a plurality of electric motors 382 are provided for driving the wheels (i.e., for propulsion). For example, each electric motor 382 may be mounted in direct association with a respective wheel 381 (e.g., electric motor mounted on the respective wheel), thereby enabling individual wheel drive. However, other mounting approaches for the electric motors are possible (e.g., an electric motor being mounted in association with a corresponding wheel axle and configured to drive the wheels of that axle, an electric motor being mounted to enable it to drive two or more wheels of one side of the vehicle, etc.).

In the context of the vehicle platform, there is provided one or more power unit(s) configured to drive the electric motor(s) 382. In some examples, the vehicle platform may provide a power unit interface configured to receive a power unit, whereby different types of power units can be utilized for the same vehicle platform.

Various types of power units include (but are not limited to): a fuel cell arrangement (FC) 330, an internal combustion engine (ICE) 310, and an energy storing system (ESS) 340 (e.g., a battery system). The power unit(s) excluding the ICE are referred to herein as other energy source(s) (OES) 320.

Any one or more of the power unit(s) may drive the electric motor(s) 382 by directly (or via an electric generator in the case of the ICE) supplying electric power/energy to the electric motor(s) and/or by supplying electric power/energy to the ESS 340, which in turn supplies electric power/energy to the electric motor(s). Thus, there is provided an ICE 310 configured to provide energy for driving the electric motor(s) 382, as well as one or more other energy source(s) 320 for driving the electric motor(s) 382.

A transfer network 390 is configured to transfer electric energy between the power units 310, 320 and the electric motor(s) 382; from the power units to the electric motor(s) during propulsion and (possibly) from the electric motor(s) to the power units during braking by the electric motor(s). The transfer network 390 may be implemented in any suitable way (e.g., using electric wiring).

The vehicle sub-system 300 comprises a controller (CNTR; e.g., controlling circuitry or a control module) 350 configured to perform, or cause performance of, one or more steps of the method 100 of FIG. 1. For example, the controller 350 may be implemented by the VCU 290 of FIG. 2. Thus, the controller 350 is configured to—while the electric motor(s) 382 are not driven by the ICE 310—control the ICE 310 to operate according to a predefined operational mode, control one or more NOx sensor(s) (SENS) 360 to perform associated measurements on the ICE exhaust gases, and acquiring corresponding measurement results from the NOx sensor(s) 360.

In some examples, the vehicle sub-system 300 further comprises one or more of: the electric motor(s) 382, the transfer network 390, the ICE 310, the NOx sensor(s) 360, and the other energy source(s) 320.

It should be noted that the vehicle platform context (where an ICE 310 and one or more other energy source(s) 320 are configured to provide electrical power for propulsion via electric motor(s) 382) greatly extends the availability of the ICE for NOx sensor measurements compared to vehicle platforms where the ICE is configured to directly provide mechanical power for the wheel drive. For example, the ICE may be used for NOx calibration measurements for a relatively long duration of time (until the other energy source(s) are emptied). Furthermore, there is relatively large possibilities to vary parameters like engine speed (moment) and torque, while such parameters would be limited by the wheel state for other types of vehicle platforms. Thus, more flexible (re-)calibration is enabled for the vehicle platform context considered here.

Figure 4:
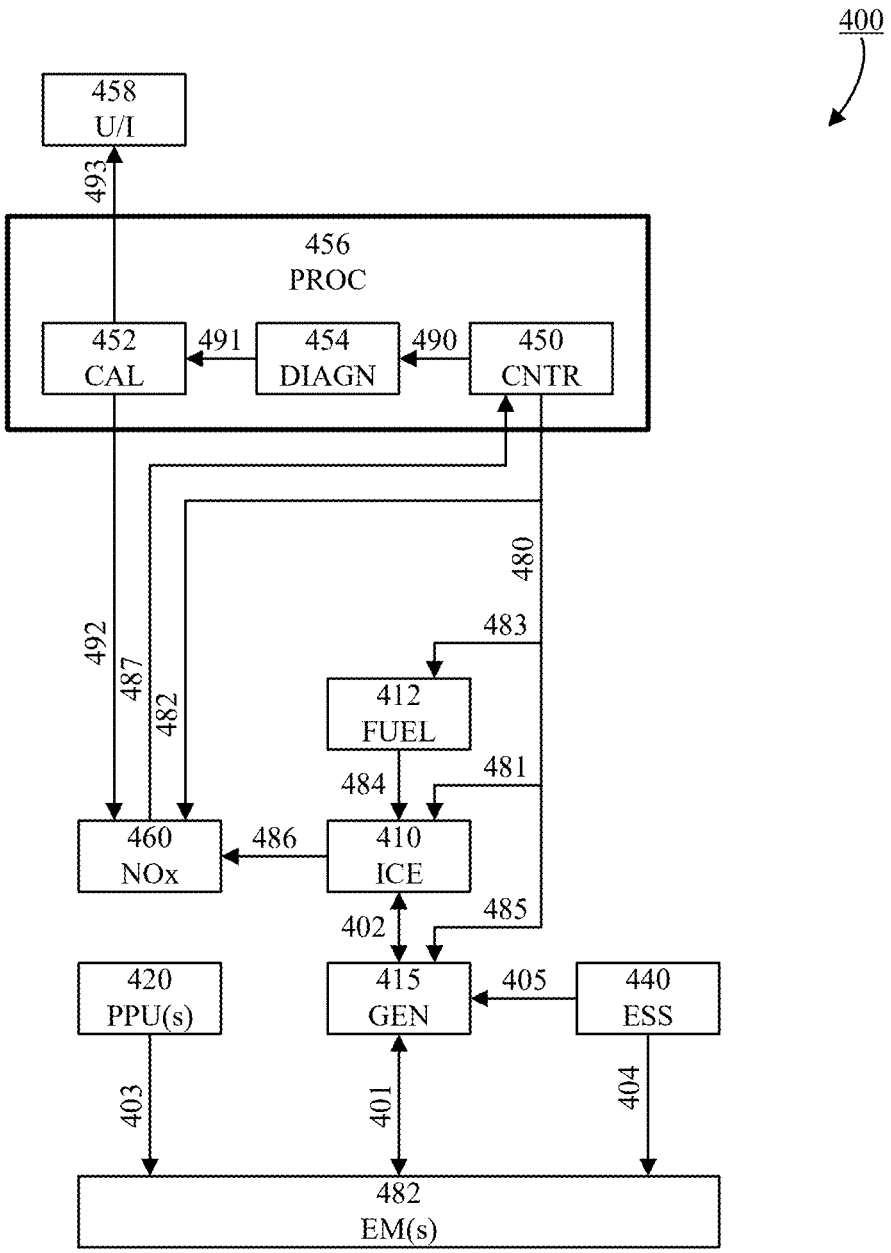
FIG. 4 is a schematic block diagram illustrating an arrangement according to some examples.

FIG. 4 schematically illustrates an arrangement 400 according to some examples. For example, the arrangement 400 may be suitable in relation to performance of one or more steps of the method 100 of FIG. 1. Alternatively or additionally, the arrangement 400 may be comprised in a vehicle (e.g., the vehicle 200 of FIG. 2). Yet alternatively or additionally, the arrangement 400 may overlap (partially or fully) with the vehicle sub-system 300 of FIG. 3.

The arrangement 400 comprises a controller (CNTR; e.g., controlling circuitry or a control module) 450, one or more electric motor(s) (EM(s)) 482, and an internal combustion engine (ICE) 410 associated with an electric generator (GEN) 415 and with one or more NOx sensor(s) 460. The arrangement 400 also comprises one or more energy source(s) other than the ICE; exemplified by an energy storing system (ESS) 440 and one or more other primary power unit(s) (PPU(s)) 420.

Any one or more of the ICE 410, the ESS 440, and the PPU(s) 420 may drive electric motor(s) 482 (via the electric generator 415 in the case of the ICE), as illustrated by 401, 402, 403, 404. Thus, there is provided an ICE 410 configured to provide energy for driving the electric motor(s) 482, as well as one or more other energy source(s) 420, 440 for driving the electric motor(s) 482.

In various examples, the arrangement 400 may also comprise one or more of a fuel controller (FUEL) 412, a user interface (U/I) 458, a diagnoser (DIAGN; e.g., diagnosing circuitry or a diagnose module) 454, and a calibrator (CAL; e.g., calibration circuitry or a calibration module) 452.

One or more of the controller 450, the diagnoser 454, and the calibrator 452 may be comprised (e.g., implemented by) a processor (PROC; e.g., processing circuitry or a processor module) 456. For example, the controller 450 and/or the processor 456 may be implemented by the VCU 290 of FIG. 2.

The controller 450 is configured to perform, or cause performance of, one or more steps of the method 100 of FIG. 1. Thus, the controller 450 is configured to—while the electric motor(s) 482 are not driven by the ICE 410—control the ICE 410 to operate according to a predefined operational mode (illustrated by 480), control the NOx sensor(s) 460 to perform associated measurements on the ICE exhaust gases 486 (illustrated by 482), and acquiring corresponding measurement results from the NOx sensor(s) 460 (illustrated by 487).

To control the ICE 410 to operate according to a predefined operational mode, the controller 450 may be configured to—for example—operate the ICE by single ignition (illustrated by 481), and/or use a corresponding specific level of fuel injection (illustrated by 483 and 484), and/or apply a corresponding torque to the crank shaft of the ICE using the electric generator 415 (illustrated by 485, 401, 405 and 402), and/or run the ICE at a corresponding engine speed (illustrated by 481).

Information pertaining to the measurement results 487 may be provided to the diagnoser 454 (as illustrated by 490), and the diagnoser 454 may be configured to compare the measurement results to the predefined expected NOx sensor response. If advisable based on the comparison (e.g., if one of the compared features differs between the measurement results and the predefined expected NOx sensor response), the diagnoser 454 may trigger the calibrator 452 (illustrated by 491) to calibrate the NOx sensor(s) 460 accordingly (illustrated by 492). In case the calibration is not successful, the calibrator 452 may issue a NOx sensor malfunction alert (illustrated by 493), for example via the user interface 458.

Figure 5:
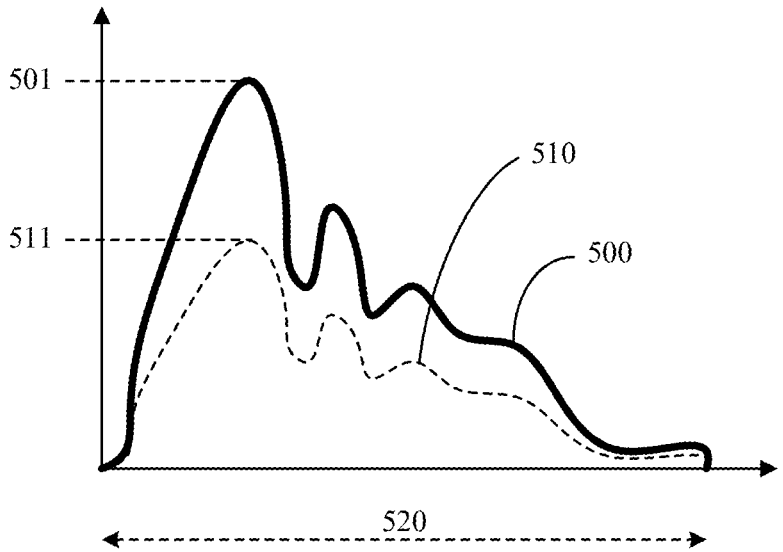
FIG. 5 is a schematic plot illustrating an NOx response according to some examples.

FIG. 5 schematically illustrates an example (pulse-shaped) predefined expected, non-zero, NOx sensor response 500 and corresponding NOx measurements 510.

In this example, the duration 520 coincide for the measured and expected responses, while the peak amplitudes 510, 511 are different.

Figure 6:
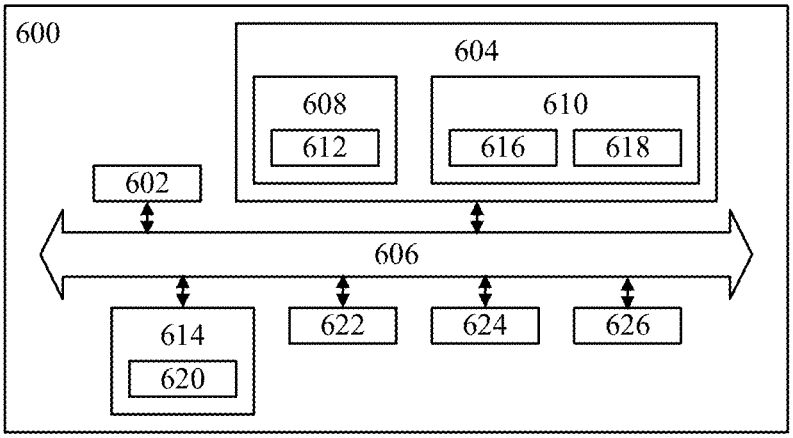
FIG. 6 is a schematic diagram illustrating a computer system for implementing examples disclosed herein according to some examples.

FIG. 6 is a schematic diagram of a computer system 600 for implementing examples disclosed herein. The computer system 600 is adapted to execute instructions from a computer-readable medium to perform these and/or any of the functions or processing described herein. The computer system 600 may be connected (e.g., networked) to other machines in a LAN (Local Area Network), LIN (Local Interconnect Network), automotive network communication protocol (e.g., FlexRay), an intranet, an extranet, or the Internet. While only a single device is illustrated, the computer system 600 may include any collection of devices that individually or jointly execute a set (or multiple sets) of instructions to perform any one or more of the methodologies discussed herein. Accordingly, any reference in the disclosure and/or claims to a computer system, computing system, computer device, computing device, control system, control unit, electronic control unit (ECU), processor device, processing circuitry, etc., includes reference to one or more such devices to individually or jointly execute a set (or multiple sets) of instructions to perform any one or more of the methodologies discussed herein. For example, control system may include a single control unit or a plurality of control units connected or otherwise communicatively coupled to each other, such that any performed function may be distributed between the control units as desired. Further, such devices may communicate with each other or other devices by various system architectures, such as directly or via a Controller Area Network (CAN) bus, etc.

The computer system 600 may comprise at least one computing device or electronic device capable of including firmware, hardware, and/or executing software instructions to implement the functionality described herein. The computer system 600 may include processing circuitry 602 (e.g., processing circuitry including one or more processor devices or control units), a memory 604, and a system bus 606. The computer system 600 may include at least one computing device having the processing circuitry 602. The system bus 606 provides an interface for system components including, but not limited to, the memory 604 and the processing circuitry 602. The processing circuitry 602 may include any number of hardware components for conducting data or signal processing or for executing computer code stored in memory 604. The processing circuitry 602 may, for example, include a general-purpose processor, an application specific processor, a Digital Signal Processor (DSP), an Application Specific Integrated Circuit (ASIC), a Field Programmable Gate Array (FPGA), a circuit containing processing components, a group of distributed processing components, a group of distributed computers configured for processing, or other programmable logic device, discrete gate or transistor logic, discrete hardware components, or any combination thereof designed to perform the functions described herein. The processing circuitry 602 may further include computer executable code that controls operation of the programmable device.

The system bus 606 may be any of several types of bus structures that may further interconnect to a memory bus (with or without a memory controller), a peripheral bus, and/or a local bus using any of a variety of bus architectures. The memory 604 may be one or more devices for storing data and/or computer code for completing or facilitating methods described herein. The memory 604 may include database components, object code components, script components, or other types of information structure for supporting the various activities herein. Any distributed or local memory device may be utilized with the systems and methods of this description. The memory 604 may be communicably connected to the processing circuitry 602 (e.g., via a circuit or any other wired, wireless, or network connection) and may include computer code for executing one or more processes described herein. The memory 604 may include non-volatile memory 608 (e.g., read-only memory (ROM), erasable programmable read-only memory (EPROM), electrically erasable programmable read-only memory (EEPROM), etc.), and volatile memory 610 (e.g., random-access memory (RAM)), or any other medium which can be used to carry or store desired program code in the form of machine-executable instructions or data structures and which can be accessed by a computer or other machine with processing circuitry 602. A basic input/output system (BIOS) 612 may be stored in the non-volatile memory 608 and can include the basic routines that help to transfer information between elements within the computer system 600.

The computer system 600 may further include or be coupled to a non-transitory computer-readable storage medium such as the storage device 614, which may comprise, for example, an internal or external hard disk drive (HDD) (e.g., enhanced integrated drive electronics (EIDE) or serial advanced technology attachment (SATA)), HDD (e.g., EIDE or SATA) for storage, flash memory, or the like. The storage device 614 and other drives associated with computer-readable media and computer-usable media may provide non-volatile storage of data, data structures, computer-executable instructions, and the like.

Computer-code which is hard or soft coded may be provided in the form of one or more modules. The module(s) can be implemented as software and/or hard-coded in circuitry to implement the functionality described herein in whole or in part. The modules may be stored in the storage device 614 and/or in the volatile memory 610, which may include an operating system 616 and/or one or more program modules 618. All or a portion of the examples disclosed herein may be implemented as a computer program 620 stored on a transitory or non-transitory computer-usable or computer-readable storage medium (e.g., single medium or multiple media), such as the storage device 614, which includes complex programming instructions (e.g., complex computer-readable program code) to cause the processing circuitry 602 to carry out actions described herein. Thus, the computer-readable program code of the computer program 620 can comprise software instructions for implementing the functionality of the examples described herein when executed by the processing circuitry 602. In some examples, the storage device 614 may be a computer program product (e.g., readable storage medium) storing the computer program 620 thereon, where at least a portion of a computer program 620 may be loadable (e.g., into a processor) for implementing the functionality of the examples described herein when executed by the processing circuitry 602. The processing circuitry 602 may serve as a controller or control system for the computer system 600 that is to implement the functionality described herein.

The computer system 600 may include an input device interface 622 configured to receive input and selections to be communicated to the computer system 600 when executing instructions, such as from a keyboard, mouse, touch-sensitive surface, etc. Such input devices may be connected to the processing circuitry 602 through the input device interface 622 coupled to the system bus 606 but can be connected through other interfaces, such as a parallel port, an Institute of Electrical and Electronic Engineers (IEEE) 1394 serial port, a Universal Serial Bus (USB) port, an IR interface, and the like. The computer system 600 may include an output device interface 624 configured to forward output, such as to a display, a video display unit (e.g., a liquid crystal display (LCD) or a cathode ray tube (CRT)). The computer system 600 may include a communications interface 626 suitable for communicating with a network as appropriate or desired.

According to some examples, the computer system 600 may be suitable for enabling diagnostics of NOx sensor(s) of a vehicle as described herein.

For example, the computer system 600 may be configured to perform, or cause performance of, one or more steps of the method 100 of FIG. 1. Alternatively or additionally, the computer system 600 may be comprised in, or comprise, one or more VCU(s) (e.g., the VCU 290 of FIG. 2). Yet alternatively or additionally, the computer system 600 may be comprised in a vehicle (e.g., the vehicle 200 of FIG. 2). Yet alternatively or additionally, the computer system 600 may implement one or more of the controller 350 of FIG. 3, the controller 450 of FIG. 4, and the processor 456 of FIG. 4.

The operational actions described in any of the exemplary aspects herein are described to provide examples and discussion. The actions may be performed by hardware components, may be embodied in machine-executable instructions to cause a processor to perform the actions, or may be performed by a combination of hardware and software. Although a specific order of method actions may be shown or described, the order of the actions may differ. In addition, two or more actions may be performed concurrently or with partial concurrence.

The described examples and their equivalents may be realized in software or hardware or a combination thereof. The examples may be performed by general purpose circuitry. Examples of general purpose circuitry include digital signal processors (DSP), central processing units (CPU), co-processor units, field programmable gate arrays (FPGA) and other programmable hardware. Alternatively or additionally, the examples may be performed by specialized circuitry, such as application specific integrated circuits (ASIC). The general purpose circuitry and/or the specialized circuitry may, for example, be associated with or comprised in an electronic apparatus such as a vehicle control unit (VCU) or other suitable control unit.

The electronic apparatus may comprise arrangements, circuitry, and/or logic according to any of the examples described herein. Alternatively or additionally, the electronic apparatus may be configured to perform method steps according to any of the examples described herein.

Figure 7:
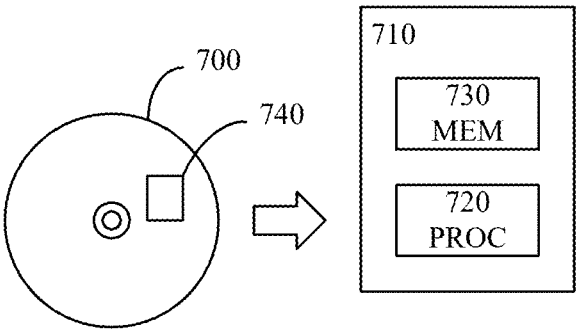
FIG. 7 is a schematic drawing illustrating a computer program product in the form of a non-transitory computer-readable storage medium according to some examples.

According to some examples, a computer program product comprises a non-transitory computer readable medium such as, for example, a universal serial bus (USB) memory, a plug-in card, an embedded drive, or a read only memory (ROM). FIG. 7 illustrates a computer program product 700 exemplified as a non-transitory computer-readable medium in the form of a compact disc (CD) ROM. The computer-readable medium has stored thereon program code 740 comprising instructions. The program code is loadable into processing circuitry (PROC; e.g., a data processing unit) 720, which may, for example, be comprised in a control unit 710. When loaded into the processing circuitry, the program code may be stored in a memory (MEM) 730 associated with, or comprised in, the processing circuitry. According to some examples, the program code may, when loaded into, and run by, the processing circuitry, cause execution of method steps according to, for example, any of the methods described herein.

Figure 8:
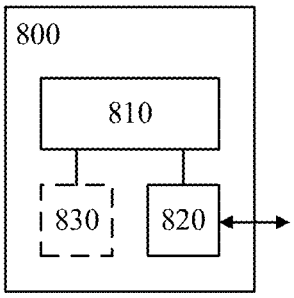
FIG. 8 is a schematic block diagram of a control unit according to some examples.

FIG. 8 schematically illustrates, in terms of a number of functional units, the components of a control unit 800 according to some examples. This control unit 800 may be comprised in the vehicle 200; e.g., in the form of a VCU 290 (compare with FIG. 2). Processing circuitry 810 is provided using any combination of one or more of a suitable central processing unit CPU, multiprocessor, microcontroller, digital signal processor DSP, etc., capable of executing software instructions stored in a computer program product, e.g. in the form of a storage medium 830. The processing circuitry 810 may further be provided as at least one application specific integrated circuit ASIC, or field programmable gate array FPGA.

Particularly, the processing circuitry 810 is configured to cause the control unit 800 to perform a set of operations, or steps, such as the method discussed in connection to FIG. 1.

For example, the storage medium 830 may store the set of operations, and the processing circuitry 810 may be configured to retrieve the set of operations from the storage medium 830 to cause the control unit 800 to perform the set of operations. The set of operations may be provided as a set of executable instructions. Thus, the processing circuitry 810 is thereby arranged to execute methods as herein disclosed. In particular, there is disclosed a control unit 800 for controlling an articulated vehicle 200 comprising a tractor 210 and/or one or more towed vehicle units 220, the control unit comprising processing circuitry 810, an interface 820 coupled to the processing circuitry 810, and a memory 830 coupled to the processing circuitry 810, wherein the memory comprises machine readable computer program instructions that, when executed by the processing circuitry, causes the control unit to perform the methods discussed herein.

The storage medium 830 may also comprise persistent storage, which, for example, can be any single one or combination of magnetic memory, optical memory, solid state memory or even remotely mounted memory.

The control unit 800 may further comprise an interface 820 for communications with at least one external device. As such, the interface 820 may comprise one or more transmitters and receivers, comprising analogue and digital components and a suitable number of ports for wireline or wireless communication.

The processing circuitry 810 controls the general operation of the control unit 800, e.g., by sending data and control signals to the interface 820 and the storage medium 830, by receiving data and reports from the interface 820, and by retrieving data and instructions from the storage medium 830. Other components, as well as the related functionality, of the control node are omitted in order not to obscure the concepts presented herein.

A Non-Exhaustive List of Examples

Example 1: A computer system for diagnostics of NOx sensor(s) of a vehicle, wherein the vehicle comprises one or more electric motor(s) for propulsion, an internal combustion engine (ICE) configured to provide energy for driving the electric motor(s), and one or more other energy source(s) for driving the electric motor(s), the computer system comprising processing circuitry configured to, while the electric motor(s) are not driven by the ICE: control the ICE to operate according to a predefined operational mode, wherein the predefined operational mode has a correspondingly predefined expected, non-zero, NOx sensor response, control the NOx sensor(s) to perform measurements associated with the predefined operational mode of the ICE, and acquire corresponding measurement results from the NOx sensor(s) for comparison to the predefined expected NOx sensor response.

Example 2: The computer system of Example 1, wherein the predefined operational mode is defined by a steady-state engine operation point and/or wherein the predefined expected NOx sensor response is defined by one or more of: a peak amplitude, a duration, a pulse shape, and a total emission.

Example 3: The computer system of any of Examples 1-2, wherein the processing circuitry is configured to control the ICE to operate according to the predefined operational mode by causing single ignition operation of the ICE.

Example 4: The computer system of any of Examples 1-3, wherein the processing circuitry is configured to control the ICE to operate according to the predefined operational mode by causing a corresponding specific level of fuel injection.

Example 5: The computer system of any of Examples 1-4, wherein the processing circuitry is configured to control the ICE to operate according to the predefined operational mode by causing a corresponding torque to be applied to a crank shaft of the ICE.

Example 6: The computer system of Example 5, wherein the processing circuitry is configured to cause the torque to be applied to the crank shaft of the ICE by controlling an electric generator of the vehicle to operate in reverse to generate the torque.

Example 7: The computer system of any of Examples 1-6, wherein the processing circuitry is configured to control the ICE to operate according to the predefined operational mode by causing the ICE to run at a corresponding engine speed.

Example 8: The computer system of any of Examples 1-7, wherein the processing circuitry is further configured to calibrate the NOx sensor(s) based on the comparison of the measurement results to the predefined expected NOx sensor response.

Example 9: The computer system of Example 8, wherein the processing circuitry is further configured to issue a NOx sensor malfunction alert responsive to calibration failure.

Example 10: The computer system of any of Examples 1-9, wherein the processing circuitry is further configured to trigger the predefined operational mode to be applied—while the electric motor(s) are not driven by the ICE—responsive to one or more of: a specific time interval having passed since previously performed measurements associated with the predefined operational mode of the ICE, and an indication of NOx sensor malfunction.

Example 11: The computer system of any of Examples 1-10, wherein the processing circuitry is further configured to—before controlling the NOx sensor(s) to perform the measurements—cause the NOx sensor(s) to be brought to a specified temperature.

Example 12: The computer system of Example 11, wherein the processing circuitry is configured to cause the NOx sensor(s) to be brought to the specified temperature by—before controlling the ICE to operate according to the predefined operational mode—controlling the ICE to preheat the NOx sensor(s).

Example 13: A computer-implemented method for diagnostics of NOx sensor(s) of a vehicle, wherein the vehicle comprises one or more electric motor(s) for propulsion, an internal combustion engine (ICE) configured to provide energy for driving the electric motor(s), and one or more other energy source(s) for driving the electric motor(s), the method comprising, while the electric motor(s) are not driven by the ICE: controlling, by processing circuitry of a computer system, the ICE to operate according to a predefined operational mode, wherein the predefined operational mode has a correspondingly predefined expected, non-zero, NOx sensor response, controlling, by the processing circuitry, the NOx sensor(s) to perform measurements associated with the predefined operational mode of the ICE, and acquiring, by the processing circuitry, corresponding measurement results from the NOx sensor(s) for comparison to the predefined expected NOx sensor response.

Example 14: The method of Example 13, wherein the predefined operational mode is defined by a steady-state engine operation point and/or wherein the predefined expected NOx sensor response is defined by one or more of: a peak amplitude, a duration, a pulse shape, and a total emission.

Example 15: The method of any of Examples 13-14, wherein controlling the ICE to operate according to the predefined operational mode comprises causing, by the processing circuitry, single ignition operation of the ICE.

Example 16: The method of any of Examples 13-15, wherein controlling the ICE to operate according to the predefined operational mode comprises causing, by the processing circuitry, a corresponding specific level of fuel injection.

Example 17: The method of any of Examples 13-16, wherein controlling the ICE to operate according to the predefined operational mode comprises causing, by the processing circuitry, a corresponding torque to be applied to a crank shaft of the ICE.

Example 18: The method of Example 17, wherein causing the torque to be applied to the crank shaft of the ICE comprises controlling, by the processing circuitry, an electric generator of the vehicle to operate in reverse to generate the torque.

Example 19: The method of any of Examples 13-18, wherein controlling the ICE to operate according to the predefined operational mode comprises causing, by the processing circuitry, the ICE to run at a corresponding engine speed.

Example 20: The method of any of Examples 13-19, further comprising calibrating, by the processing circuitry, the NOx sensor(s) based on the comparison of the measurement results to the predefined expected NOx sensor response.

Example 21: The method of Example 20, further comprising issuing, by the processing circuitry, a NOx sensor malfunction alert responsive to calibration failure.

Example 22: The method of any of Examples 13-21, further comprising triggering, by the processing circuitry, the predefined operational mode to be applied—while the electric motor(s) are not driven by the ICE—responsive to one or more of: a specific time interval having passed since previously performed measurements associated with the predefined operational mode of the ICE, and an indication of NOx sensor malfunction.

Example 23: The method of any of Examples 13-22, further comprising—before controlling the NOx sensor(s) to perform the measurements—causing, by the processing circuitry, the NOx sensor(s) to be brought to a specified temperature.

Example 24: The method of Example 23, wherein causing the NOx sensor(s) to be brought to the specified temperature comprises—before controlling the ICE to operate according to the predefined operational mode—controlling, by the processing circuitry, the ICE to pre-heat the NOx sensor(s).

Example 25: A vehicle comprising NOx sensor(s), one or more electric motor(s) for propulsion, an internal combustion engine (ICE) configured to provide energy for driving the electric motor(s), one or more other energy source(s) for driving the electric motor(s), and the computer system of any of Examples 1-12.

Example 26: A computer program product comprising program code for performing, when executed by the processing circuitry, the method of any of Examples 13-24.

Example 27: A non-transitory computer-readable storage medium comprising instructions, which when executed by the processing circuitry, cause the processing circuitry to perform the method of any of Examples 13-24.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

What is claimed is:

1. A computer system configured to perform diagnostics of NOx sensor(s) of a vehicle, wherein the vehicle comprises one or more electric motor(s) configured to provide propulsion, an internal combustion engine—ICE—configured to provide energy via an electric generator to directly drive the electric motor(s), and one or more other energy source(s) configured to provide energy to drive the electric motor(s), the computer system comprising processing circuitry configured to, while the vehicle is in motion and the electric motor(s) are used for propulsion while not driven by the ICE:

control the ICE to operate according to a predefined operational mode, wherein the predefined operational mode has a correspondingly predefined expected, non-zero, NOx sensor response;

control the NOx sensor(s) to perform measurements associated with the predefined operational mode of the ICE; and acquire corresponding measurement results from the NOx sensor(s) for comparison to the predefined expected NOx sensor response.

2. A vehicle comprising NOx sensor(s), one or more electric motor(s) for propulsion, an internal combustion engine—ICE—configured to provide energy for driving the electric motor(s), one or more other energy source(s) for driving the electric motor(s), and the computer system of claim 1.

3. A computer-implemented method performing diagnostics of NOx sensor(s) of a vehicle, wherein the vehicle comprises one or more electric motor(s) configured to provide propulsion, an internal combustion engine—ICE—configured to provide energy via an electric generator to directly drive the electric motor(s), and one or more other energy source(s) configured to provide energy to drive the electric motor(s), the method comprising, while vehicle is in motion and the electric motor(s) are used for propulsion while not driven by the ICE:

controlling, by processing circuitry of a computer system, the ICE to operate according to a predefined operational mode, wherein the predefined operational mode has a correspondingly predefined expected, non-zero, NOx sensor response;

controlling, by the processing circuitry, the NOx sensor(s) to perform measurements associated with the predefined operational mode of the ICE; and acquiring, by the processing circuitry, corresponding measurement results from the NOx sensor(s) for comparison to the predefined expected NOx sensor response.

4. The method of claim 3, wherein the predefined operational mode is defined by a steady-state engine operation point and/or wherein the predefined expected NOx sensor response is defined by one or more of: a peak amplitude, a duration, a pulse shape, and a total emission.

5. The method of claim 3, wherein controlling the ICE to operate according to the predefined operational mode comprises causing, by the processing circuitry, single ignition operation of the ICE.

6. The method of claim 3, wherein controlling the ICE to operate according to the predefined operational mode comprises causing, by the processing circuitry, a corresponding specific level of fuel injection.

7. The method of claim 3, wherein controlling the ICE to operate according to the predefined operational mode comprises causing, by the processing circuitry, a corresponding torque to be applied to a crank shaft of the ICE.

8. The method of claim 7, wherein causing the torque to be applied to the crank shaft of the ICE comprises controlling, by the processing circuitry, an electric generator of the vehicle to operate in reverse to generate the torque.

9. The method of claim 3, wherein controlling the ICE to operate according to the predefined operational mode comprises causing, by the processing circuitry, the ICE to run at a corresponding engine speed.

10. The method of claim 3, further comprising calibrating, by the processing circuitry, the NOx sensor(s) based on the comparison of the measurement results to the predefined expected NOx sensor response.

11. The method of claim 10, further comprising issuing, by the processing circuitry, a NOx sensor malfunction alert responsive to calibration failure.

12. The method of claim 3, further comprising triggering, by the processing circuitry, the predefined operational mode to be applied—while the electric motor(s) are not driven by the ICE—responsive to one or more of:

a specific time interval having passed since previously performed measurements associated with the predefined operational mode of the ICE; and an indication of NOx sensor malfunction.

13. The method of claim 3, further comprising—before controlling the NOx sensor(s) to perform the measurements—causing, by the processing circuitry, the NOx sensor (s) to be brought to a specified temperature.

14. The method of claim 13, wherein causing the NOx sensor(s) to be brought to the specified temperature comprises—before controlling the ICE to operate according to the predefined operational mode—controlling, by the processing circuitry, the ICE to pre-heat the NOx sensor(s).

15. A computer program product comprising program code for performing, when executed by the processing circuitry, the method of claim 3.

16. A non-transitory computer-readable storage medium comprising instructions, which when executed by the processing circuitry, cause the processing circuitry to perform the method of claim 3.

* * * * *